US010668753B2

(12) United States Patent
Profaca

(10) Patent No.: US 10,668,753 B2
(45) Date of Patent: Jun. 2, 2020

(54) INTEGRATED INKJET MODULE

(71) Applicant: Memjet Technology Limited, Dublin (IE)

(72) Inventor: Mark Profaca, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 16/164,703

(22) Filed: Oct. 18, 2018

(65) Prior Publication Data

US 2019/0118537 A1 Apr. 25, 2019

Related U.S. Application Data

(60) Provisional application No. 62/574,704, filed on Oct. 19, 2017.

(51) Int. Cl.

| | |
|---|---|
| ***B41J 25/34*** | (2006.01) |
| ***B41J 29/02*** | (2006.01) |
| ***B41J 2/165*** | (2006.01) |
| ***B41J 25/304*** | (2006.01) |
| ***B41J 19/00*** | (2006.01) |
| ***B41J 2/145*** | (2006.01) |

(52) U.S. Cl.

CPC ..... *B41J 25/34* (2013.01); *B41J 2/145* (2013.01); *B41J 2/16505* (2013.01); *B41J 2/16511* (2013.01); *B41J 2/16523* (2013.01); *B41J 2/16547* (2013.01); *B41J 2/16585* (2013.01); *B41J 19/005* (2013.01); *B41J 25/304* (2013.01); *B41J 29/02* (2013.01); *B41J 2202/20* (2013.01)

(58) Field of Classification Search

CPC .... B41J 25/34; B41J 2/16523; B41J 2/16505; B41J 2/16547; B41J 2/16511; B41J 2/16585; B41J 29/02; B41J 25/304; B41J 19/005; B41J 2/145; B41J 2202/20; B41J 2002/1655

See application file for complete search history.

(56) References Cited

U.S. PATENT DOCUMENTS

| | | | | |
|---|---|---|---|---|
| 2009/0122107 | A1* | 5/2009 | Ray | B41J 2/16547 347/37 |
| 2011/0043586 | A1* | 2/2011 | Silverbrook | B41J 3/60 347/104 |
| 2012/0194607 | A1* | 8/2012 | Iwasa | B41J 2/16505 347/29 |

OTHER PUBLICATIONS

International Search Report dated Jan. 8, 2019, for PCT application No. PCT/EP2018/075109, filed on Sep. 17, 2018, 4 pages.

Written Opinion of the International Searching Authority dated Jan. 8, 2019, for PCT application No. PCT/EP2018/075109, filed on Sep. 17, 2018, 7 pages.

* cited by examiner

*Primary Examiner* — Bradley W Thies

(74) *Attorney, Agent, or Firm* — Cooley LLP

(57) ABSTRACT

An integrated inkjet module includes: first and second opposite end brackets; a single print module asymmetrically positioned between the end brackets, the print module having an elongate printhead; a wiper carriage positioned between a first end of the print module and the first end bracket, the wiper carriage being configured for longitudinally wiping the printhead; and a print module carrier mounted between the first and second end brackets. The print module includes a mounting arm bridging over the wiper carriage and the print module carrier is slidably liftable relative to the first and second end brackets.

12 Claims, 12 Drawing Sheets

INTEGRATED INKJET MODULE

CROSS-REFERENCE TO RELATED APPLICATIONS

This application claims priority to and the benefit of U.S. Provisional Patent Application No. 62/574,704, entitled INTEGRATED INKJET MODULE FOR SCALABLE PRINTER, filed on Oct. 19, 2017, the disclosure of which is incorporated herein by reference in its entirety.

FIELD OF THE INVENTION

This invention relates to a print engine and integrated inkjet modules for a digital inkjet press. It has been developed primarily for integrating an array of inkjet modules into a low-cost digital inkjet press suitable for short-run print jobs.

BACKGROUND OF THE INVENTION

Inkjet printers employing Memjet® technology are commercially available for a number of different printing formats, including desktop printers, digital inkjet presses and wideformat printers. Memjet® printers typically comprise one or more stationary inkjet printhead cartridges, which are user-replaceable. For example, a desktop label printer comprises a single user-replaceable multi-colored printhead cartridge, a high-speed label printer comprises a plurality of user-replaceable monochrome printhead cartridges aligned along a media feed direction, and a wideformat printer comprises a plurality of user-replaceable printhead cartridges in a staggered overlapping arrangement so as to span across a wideformat pagewidth.

U.S. application Ser. No. 15/582,998 filed 1 May 2017, the contents of which are incorporated herein by reference, describes a commercial pagewide printing system comprising an N×M two-dimensional array of print modules. Providing OEM customers with the flexibility to select the dimensions and number of printheads in an N×M array in a modular, cost-effective kit form enables access to a wider range of commercial digital printing markets that are traditionally served by offset printing systems.

Nevertheless, it is still desirable to simplify integration of modules into a scalable pagewide array. Simplifying integration shortens the development time and lowers costs for OEMs wishing to commercialize digital inkjet print presses.

SUMMARY OF THE INVENTION

In a first aspect, there is provided an integrated inkjet module for a scalable inkjet printer, the inkjet module comprising:

first and second opposite end brackets;

a single print module asymmetrically positioned between the end brackets; and a maintenance module for maintaining an inkjet printhead of the print module, the maintenance module comprising an L-shaped frame fixedly mounted between the end brackets, the L-shaped frame having a longer leg extending along one side of the print module and a shorter leg positioned between a first end of the print module and the first end bracket, wherein:

the print module is slidably liftable relative to the end brackets;

the longer leg includes a laterally extendible capper for capping the printhead; and the shorter leg includes a longitudinally movable wiper carriage for wiping the printhead.

Preferably, the printhead of the print module extends and retracts through a space defined by the L-shaped frame between a printing position and a maintenance position, respectively.

Preferably, the L-shaped frame is wrapped around only one longitudinal side and the first end of the print module.

Preferably, the inkjet module further comprises:

a print module carrier; and a lift mechanism for raising and lowering the print module carrier.

Preferably, the print module carrier is slidably engaged between first and second guide rails of the first and second end brackets, respectively.

Preferably, the print module carrier comprises a sleeve for receiving the print module and a pair of mounting brackets connected to the sleeve, wherein each mounting bracket is engaged with a respective guide rail.

Preferably, the mounting brackets comprise one or more roller bearings for engagement with the first and second guide rails.

Preferably, a first mounting bracket is connected to the sleeve via a mounting arm bridging over the wiper carriage.

Preferably, the lift mechanism comprises one or more pinions engaged with respective racks of the print module carrier.

Preferably, the inkjet module further comprises a cable support at a rear face of the inkjet module.

In some embodiments, the inkjet module further comprises a platen or a spittoon structure connected between the first and second end brackets.

In a further aspect, there is provided a print engine comprising one or more inkjet modules as described hereinabove.

In a second aspect, there is provided an integrated inkjet module comprising:

first and second opposite end brackets;

a single print module asymmetrically positioned between the end brackets, the print module comprising an elongate printhead;

a wiper carriage positioned between a first end of the print module and the first end bracket, the wiper carriage being configured for longitudinally wiping the printhead; and a print module carrier supporting the print module, the print module carrier being mounted between the first and second end brackets and comprising a mounting arm bridging over the wiper carriage, wherein the print module carrier is slidably liftable relative to the first and second end brackets.

Preferably, the inkjet module comprises a lift mechanism for raising and lowering the print module carrier.

Preferably, the lift mechanism comprises a rack-and-pinion mechanism.

Preferably, the print module carrier is slidably engaged between first and second guide rails of the first and second end brackets, respectively.

Preferably, the mounting brackets comprise one or more roller bearings for engagement with the first and second guide rails.

Preferably, the print module carrier comprises a sleeve for receiving the print module and a pair of mounting brackets engaged with respective guide rails, and wherein first mounting bracket is connected to the sleeve via the mounting arm bridging over the wiper carriage.

Preferably, the inkjet module further comprises a capper extending alongside one longitudinal edge of the print module.

Preferably, the capper is reciprocally movable towards and away from the printhead.

In a third aspect, there is provided an inkjet module comprising:

first and second opposite end brackets;

a print module slidably mounted between the end brackets for raising and lowering the print module relative to the end brackets, the print module having a front face, a rear face and an elongate printhead positioned at a lower surface of the print module; and a cable array comprising a plurality of laterally arranged cables connected to the print module, wherein the cables of the cable array extend in a common plane parallel to the rear face of the print module and follow a curved path such that an outer cable is longer than an inner cable.

Preferably, the inkjet modules comprises a cable pocket for supporting at least part of the cable array.

Preferably, the cable pocket is fixedly mounted between the end brackets and comprises a backplate parallel with the rear face of the print module.

Preferably, the plurality of cables comprises one or more of: electrical cables and fluid lines.

Preferably, the cable array flexes between first and second configurations corresponding to lowered and raised positions of the print module.

Preferably, the cable array follows a path from an upper part of the print module towards the second end bracket, around a bend towards a lower part of the inkjet module, and then towards the first end bracket.

In a further aspect, there is provided a print engine comprising a print chassis having a plurality of inkjet modules as described above mounted thereon.

Preferably, the print chassis comprises a cable tray extending along one side thereof for receiving the cable arrays of the inkjet modules.

Preferably, the cable tray extends parallel with a media feed direction.

Preferably, the print modules are aligned with each other along the media feed direction.

Preferably, the print engine is absent any overhead cables.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, fixatives (e.g. pre-coats and finishers), 3D printing fluids and the like.

As used herein, the term "mounted" includes both direct mounting and indirect mounting via an intervening part.

BRIEF DESCRIPTION OF THE DRAWINGS

Embodiments of the present invention will now be described by way of example only with reference to the accompanying drawings, in which.

DETAILED DESCRIPTION OF THE INVENTION

Print Engine

Figure 1:
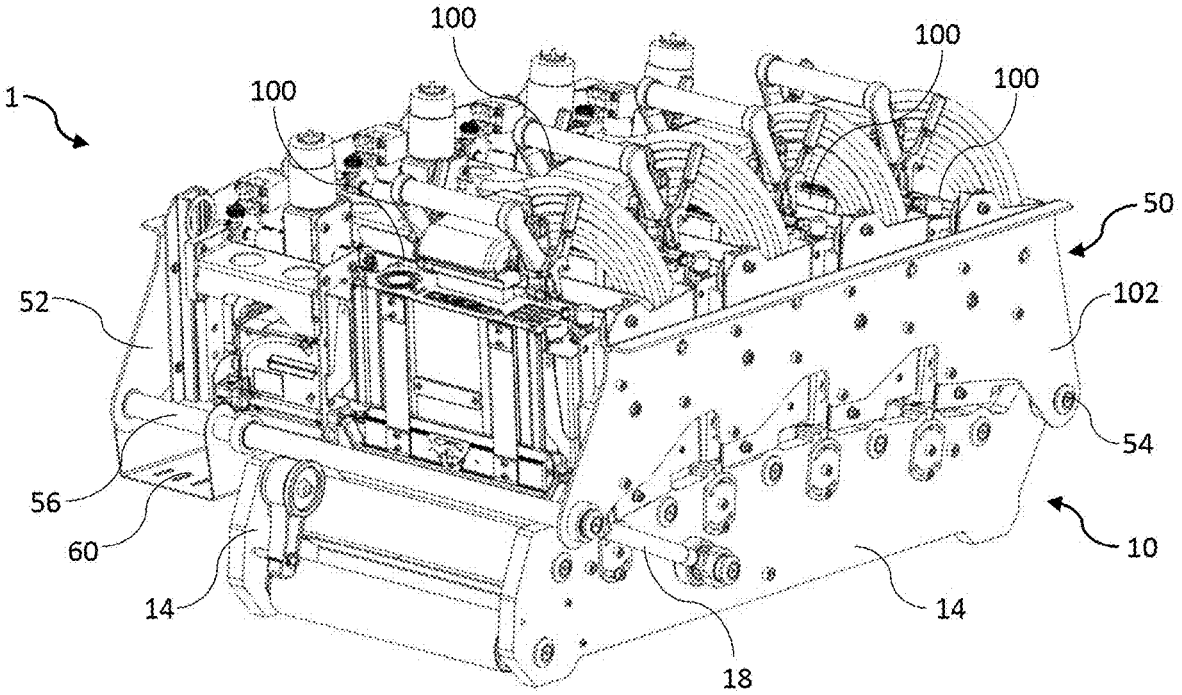
FIG. 1 is a perspective view of a print engine having a plurality of inkjet modules in a closed position.
Figure 2:
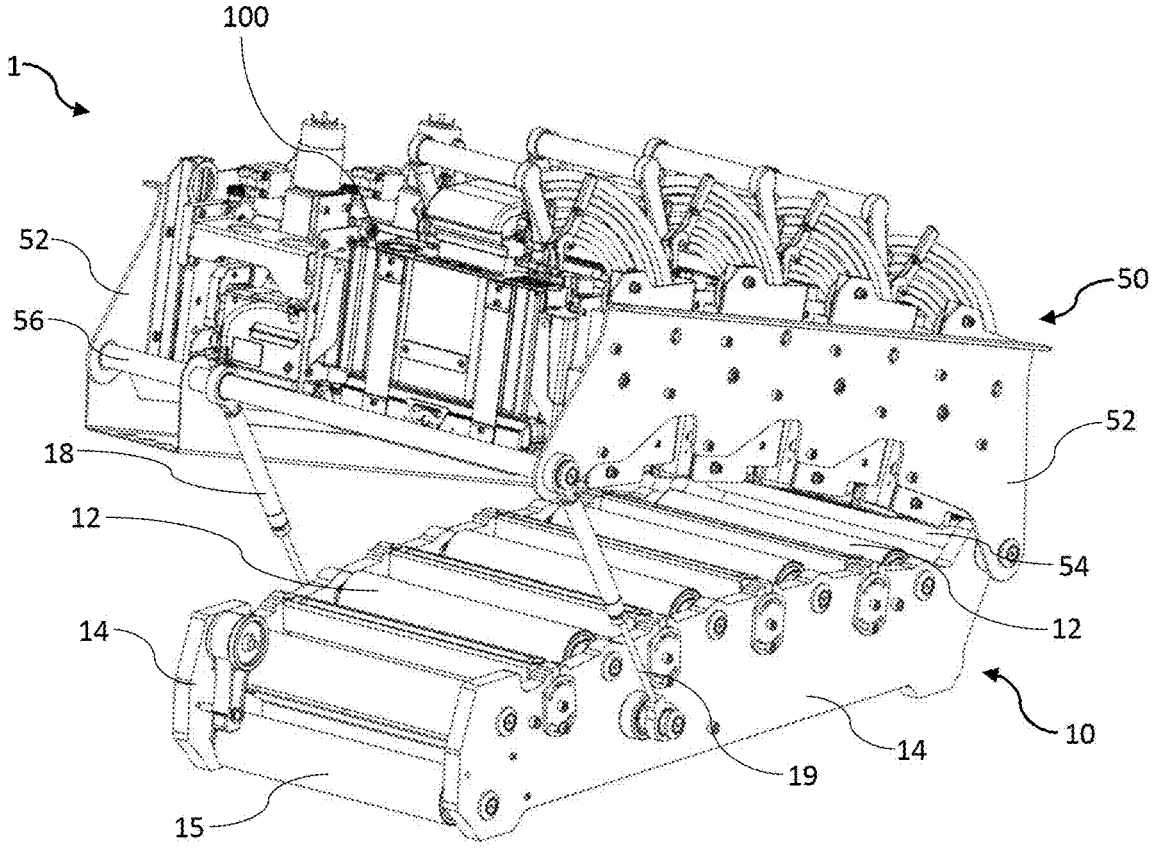
FIG. 2 is a perspective of the print engine shown in FIG. 1 in an open position.

Referring to FIGS. 1 and 2 there is shown a print engine 1 for full-color printing onto a media web. The print engine 1 is designed for OEM-customization into digital inkjet presses meeting individual customers' requirements. The print engine 1 comprises a media support chassis 10 having a set of guide rollers 12 rotatably mounted between opposite support chassis side plates 14. The guide rollers 12 are arranged so as to define a curved (convex) media feed path, which is optimal for tensioning the media web during printing. A media feed mechanism, such as those typically used in conventional offset presses (not shown), may be used for feeding the media web towards an input roller 15 positioned below the set of guide rollers 12 and then away from the print engine 1 under suitable tension.

A print chassis 50 is mounted on the media support chassis 10 and comprises a pair of opposed print chassis side plates 52 connected at opposite ends via a first shaft 54 and a second shaft 56. The first shaft 54 defines a pivot axis for pivoting the print chassis 50 relative to the media support chassis 10. This mounting arrangement allows the print chassis 50 to pivot between a closed position (FIG. 1) and an open position (FIG. 2). In the open position, the guide rollers 12 and media web are readily accessible, which allows the media web to be threaded through the print engine 1 or accessed when necessary. Pivoting of the print chassis 50 is actuated by a pair of piston mechanisms 18 linking the media support chassis 10 to the second shaft 56 of the print chassis. Actuation of the piston mechanism 18 extends a piston rod 19, which pivots the print chassis 50 away from the media support chassis 10 into the open position shown in FIG. 2.

The print chassis 50 supports four integrated inkjet modules 100, which are fixedly mounted between the print chassis side plates 52 and aligned along a length of the print engine 1. The inkjet modules 100 are mounted radially with respect to the curved media feed path defined by the guide rollers 12. Each inkjet module 100 is a self-contained unit comprising all the necessary components for printing, capping and servicing a fixed pagewide printhead in a compact, fully-integrated assembly. As shown in FIG. 1, the inkjet modules 100 are stacked along a media feed path to provide a scalable pagewide array for each of four colors (cyan, magenta, yellow and black). However, it will be appreciated that a fewer or greater number of inkjet modules 100 may be employed in the print engine 1 (e.g. an additional spot color inkjet module). Furthermore, the print engine 1 may employ alternative stacking arrangements of the inkjet modules 100 (e.g. staggered and overlapping across a wider media feed path). Hence, the integrated design of the inkjet modules 100 allows facile construction of print engines in a versatile and scalable manner to provide a desired print engine with any number of inkjet modules in an N×M array.

Inkjet Module 100

Figure 3:
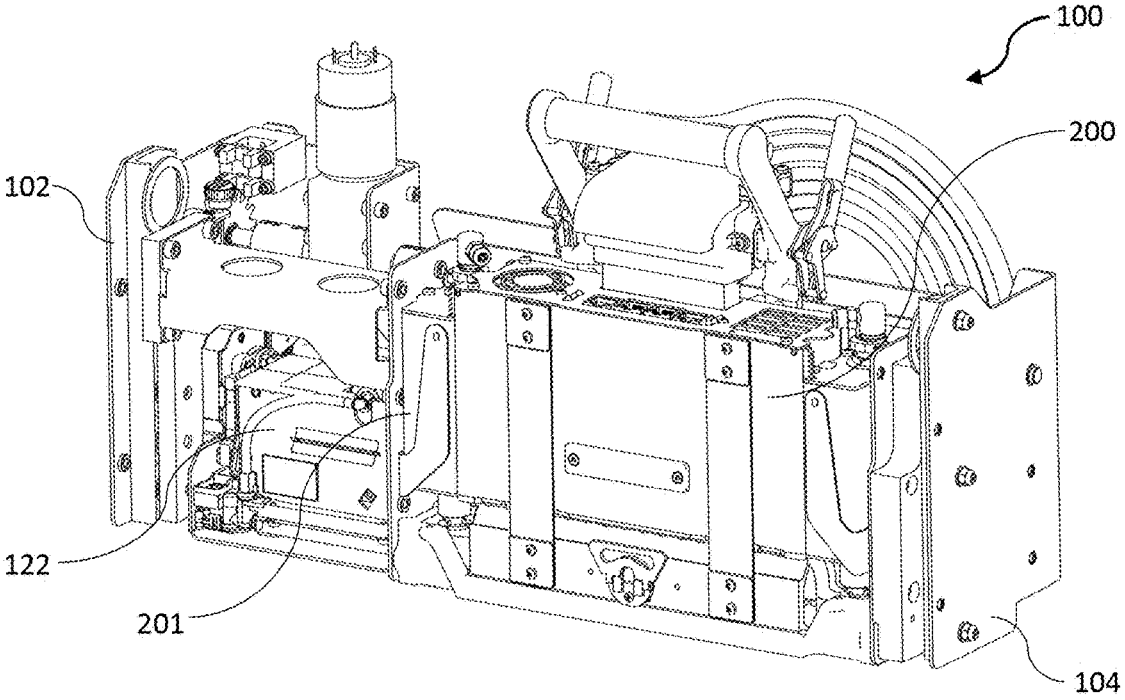
FIG. 3 is a front perspective of an inkjet module in a printing position.
Figure 4:
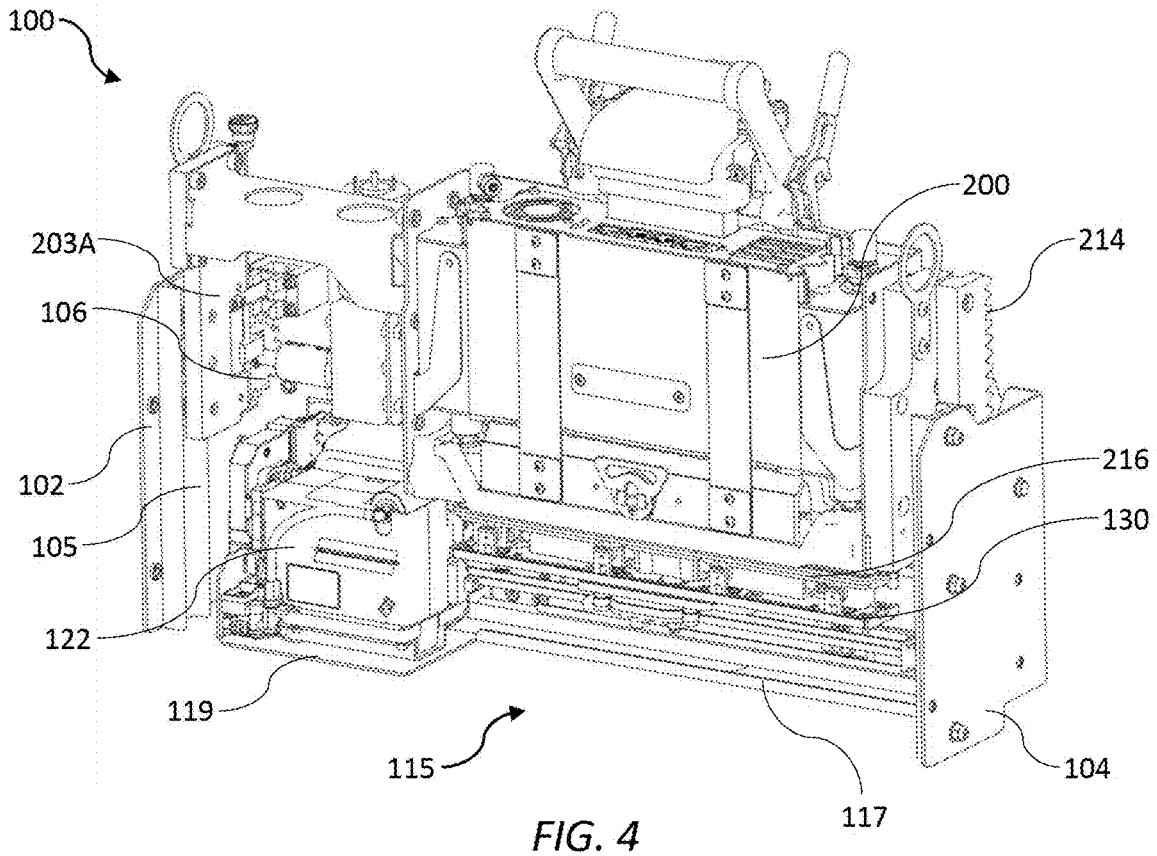
FIG. 4 is a front perspective the inkjet module shown in FIG. 3 in a maintenance position.
Figure 5:
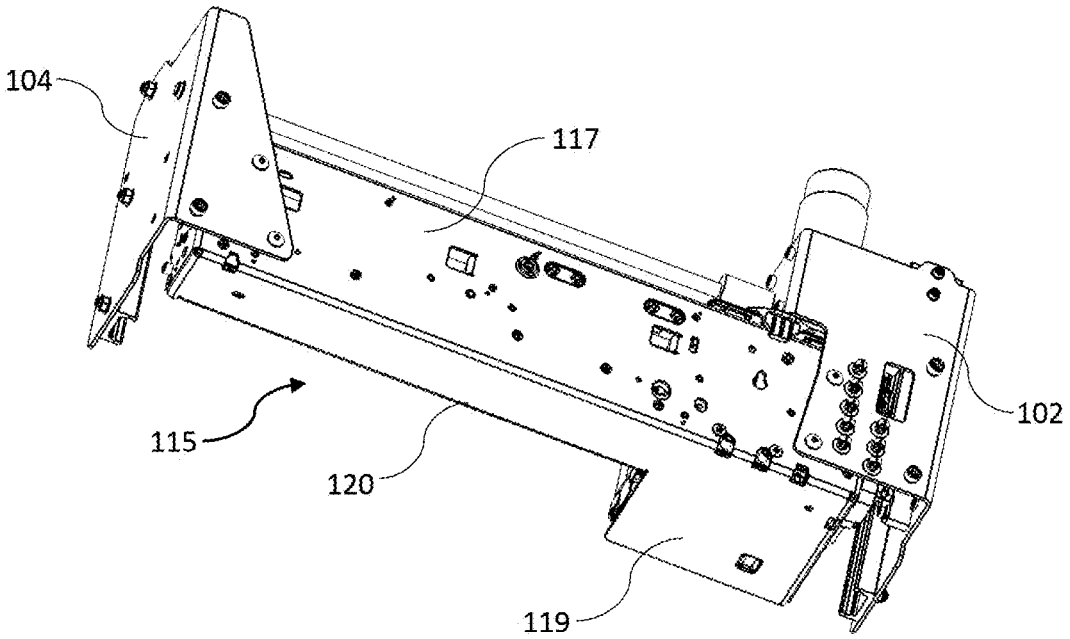
FIG. 5 is a rear perspective of the inkjet module with a print module carrier and cable pocket removed.
Figure 6:
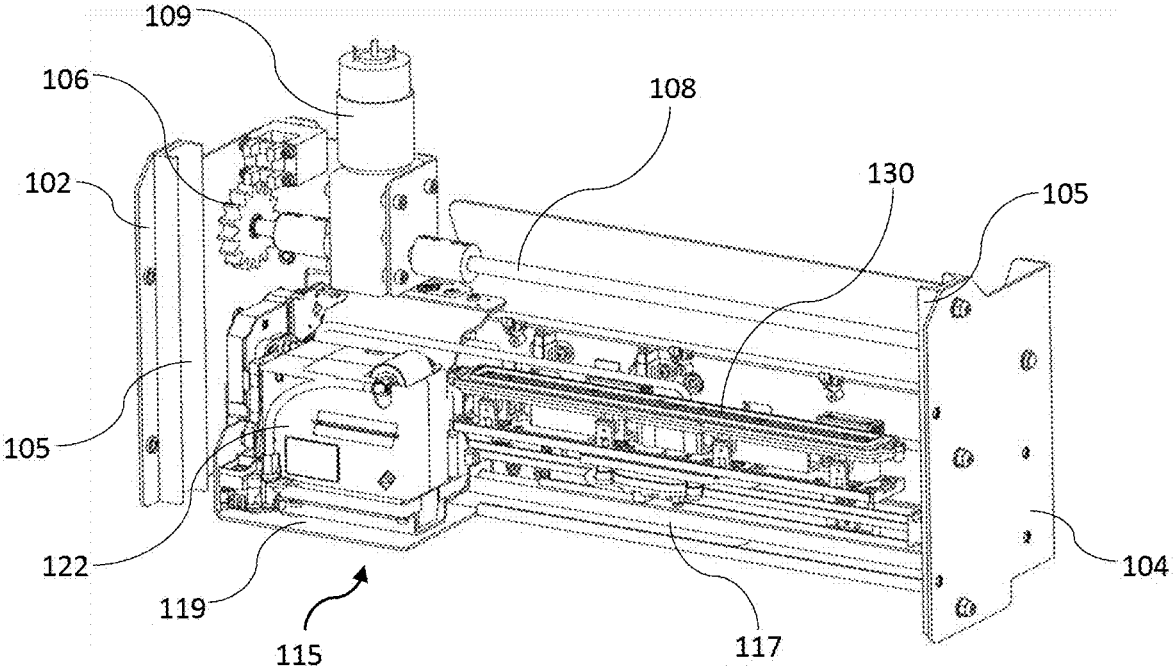
FIG. 6 is a front perspective the inkjet module with the print module carrier removed.

FIGS. 3 to 18 show in detail the inkjet module 100 as well as various components thereof. Referring initially to FIGS. 3 and 4, each inkjet module 100 comprises a first end bracket 102 and an opposite second end bracket 104, which support and house the main components of the inkjet module: a print module 200 having an inkjet printhead 216 and a maintenance module 115 for maintaining the inkjet printhead 216.

The maintenance module 115 has an L-shaped frame 120 fixedly mounted between the end brackets 102. The L-shaped frame 120 comprises a longer leg 117 fixed at each end to respective first and second end brackets 102 and 104, which together provide structural rigidity and support for the inkjet module 100 (see FIG. 5). The longer leg 117 extends longitudinally along one side of a print module 200, while a shorter leg 119 of the L-shaped frame extends transversely from the longer leg so as to be positioned between a first end 201 of the print module and the first end bracket 102. Hence, the print module 200 is asymmetrically positioned between the end brackets, being relative closer to the second end bracket 104 than the first end bracket 102.

The print module 200 is slidably liftable relative to the end brackets 102 and 104 and the L-shaped frame 120 so to allow maintenance of the printhead 216. In a printing position (FIG. 3), the print module 200 is lowered so as to extend through a space defined by the L-shaped frame 120; and in a maintenance position (FIG. 4), the print module is raised to allow either capping or wiping of the printhead. The longer leg 117 of the maintenance module 115 houses a capper 130, which is laterally extendible towards and away from the print module 200, while the shorter leg 119 houses a wiper carriage 122 which is movable longitudinally along the print module for wiping the printhead. Capping and wiping operations of the maintenance module 115 will be described in further detail below.

Figure 7:
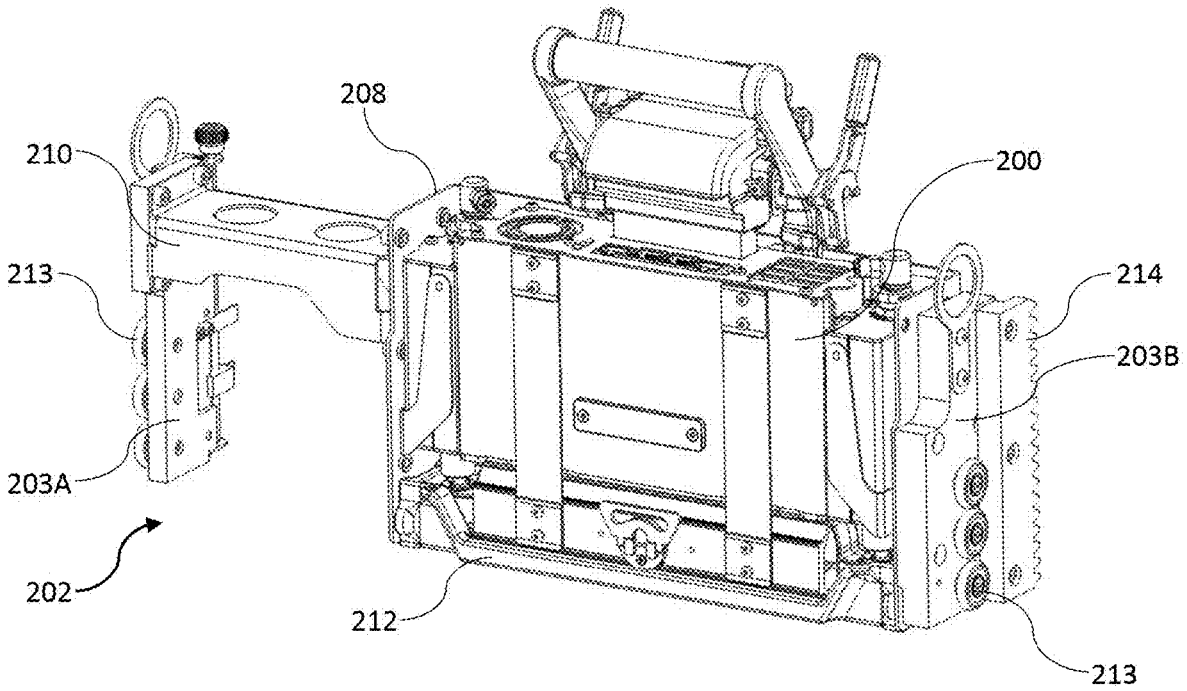
FIG. 7 is a front perspective of a print module carrier holding a print module.
Figure 8:
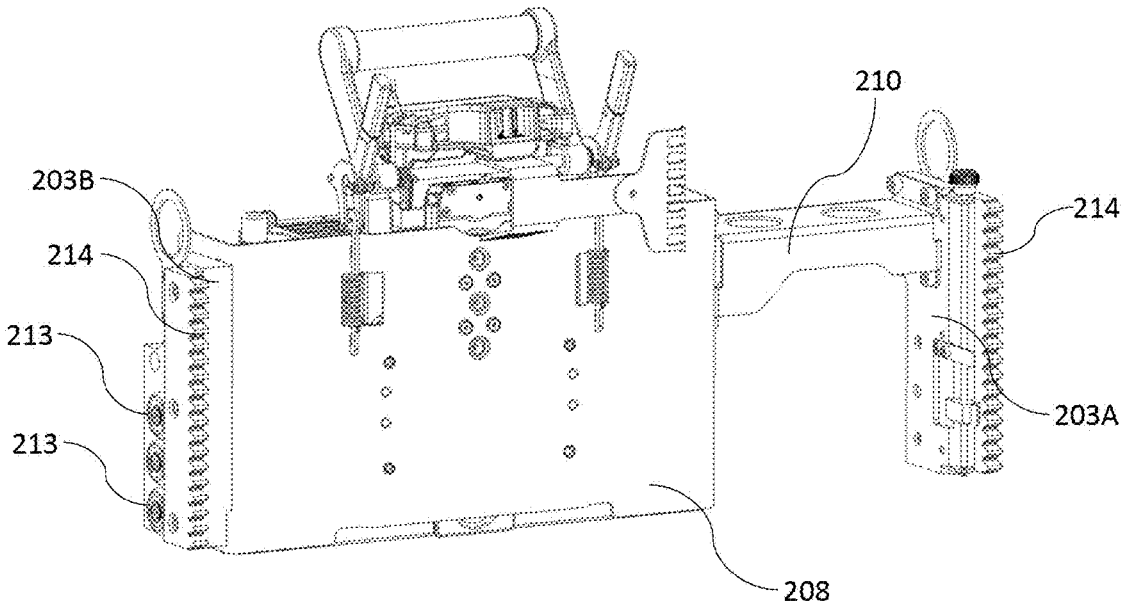
FIG. 8 is a rear perspective of the print module carrier shown in FIG. 7.
Figure 9:
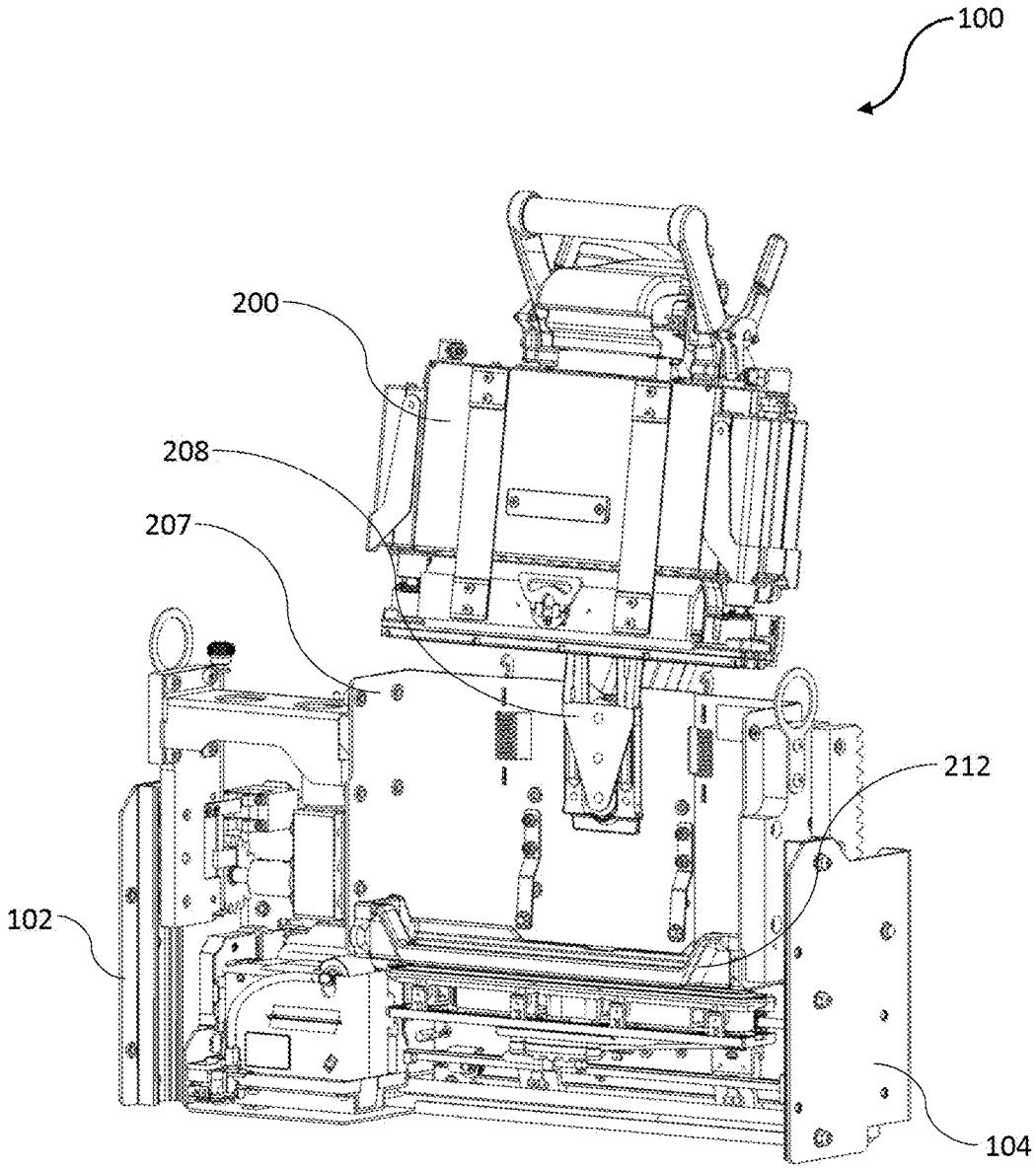
FIG. 9 is a front perspective of the inkjet module with the print module raised and removed from its sleeve.

Referring to FIGS. 7 to 9, the print module 200 is securely and releasably engaged with a print module carrier 202, which is, in turn, slidably engaged with the end brackets 102 and 104 for sliding lifting movement of the print module carrier. The print module carrier 202 comprises a sleeve 207 having a printhead nest 212 at a base thereof for datuming the print module 200; and a latch mechanism 208 for latching the print module in a raised position (FIG. 9) for replacing printheads 216. A pair of first and second slider brackets 203A and 203B are connected to opposite ends of the sleeve 207, each being slidably engaged with complementary guide rails 105 of respective first and second end brackets 102 and 104 (FIG. 4). The first slider bracket 203A is attached to the sleeve 207 via a mounting arm 210 extending outwardly from a first side of the sleeve, while the second slider bracket 203B is directly attached to an opposite second side of the sleeve. The mounting arm 210 bridges over the wiper carriage 122 in its parked position at one end of the print module 200 (FIG. 3).

Each slider bracket 203A and 203B has a plurality of bearings 213 rotatably mounted thereon to facilitate sliding movement along its respective guide rail 105. Movement of the print module carrier 202 is effected by means of a lift mechanism in the form of a rack-and-pinion mechanism. The slider brackets 203A and 203B each comprise a rack 214 for toothed engagement with a complementary pinion 106 of the inkjet module 100. The pinions 106 are co-mounted about each end of a common pinion shaft 108 extending between the first and second end brackets 102 and 104. The pinion shaft 108 is operatively connected to a lift motor 109, such that actuation of the motor rotates the pinion shaft and causes either lifting or lowering of the print module carrier 202 via rack-and-pinion engagement. The lift motor 109 may be reversible for lifting and lowering actions; alternatively, the pinion shaft 108 may be mounted via a one-way clutch and lowered under gravity.

Figure 10:
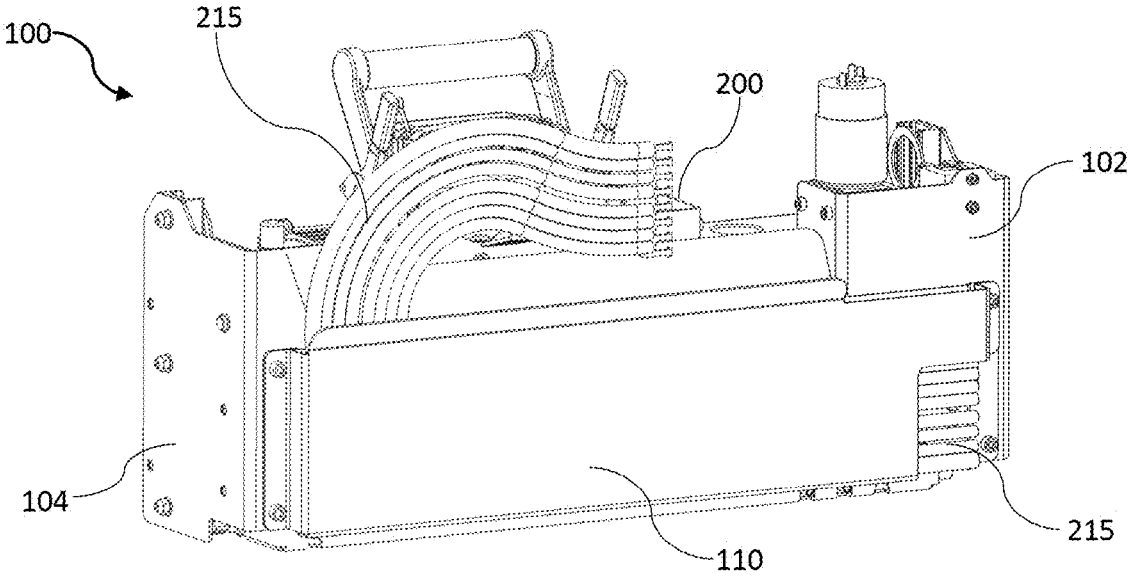
FIG. 10 is a rear perspective of the inkjet module with a cable array.
Figure 11:
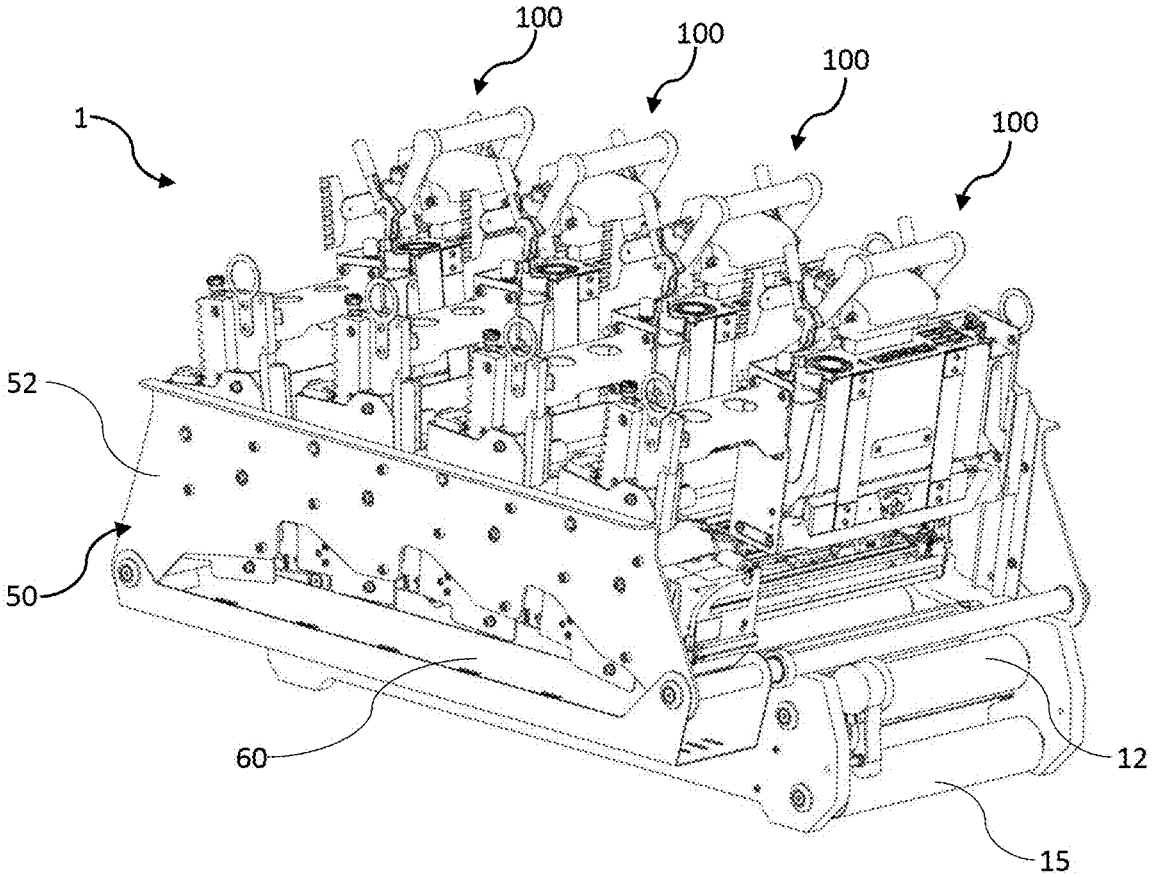
FIG. 11 is a perspective of the print engine showing a cable tray.
Figure 21:
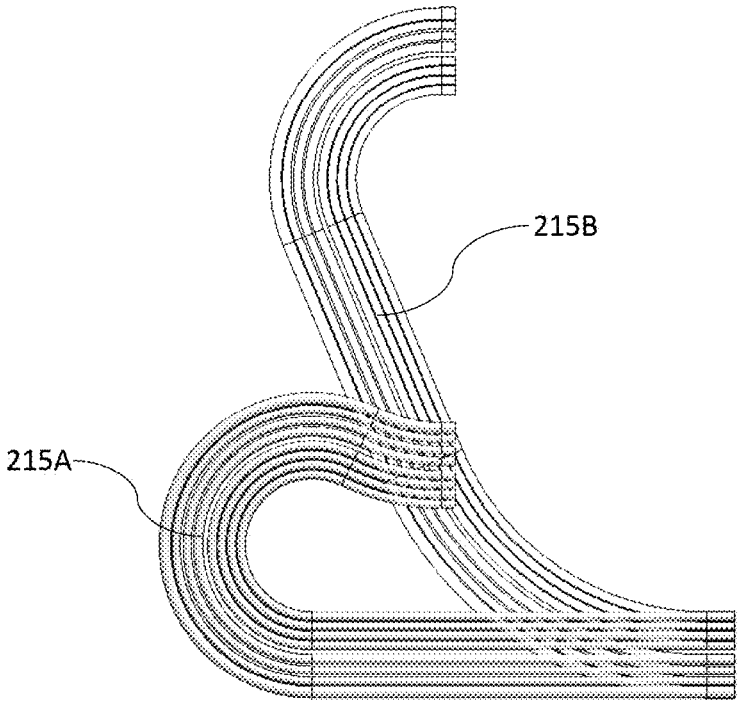
FIG. 21 shows cable array configurations for raised and lowered positions of the print module.

Referring to FIGS. 10 and 11, each inkjet module 100 includes a cable support in the form of a pocket 110 at a rear face of the module. The pocket 110 accommodates an array 215 of electrical cables and/or fluid lines laterally arranged in a plane parallel to the rear face of the inkjet module 100 and connected to an upper part of the print module 200. In contrast with conventional energy chains, the cable arrangement is configured to allow lateral bending in a plane of the cable array 215 when the print module 200 is raised and lowered between its maintenance and printing positions. (FIG. 21 shows a first cable array configuration 215A when the print module 200 is in a lowered position for printing; and a second cable array configuration 215B when the print module is in a raised position for maintenance). Each inkjet module 100 feeds the cable array 215 into its respective rear pocket 110 and thence into a common cable tray 60 extending along one side of the print chassis 50. This arrangement obviates conventional overhead cable support structures for the print engine 1.

Maintenance Module 115

The maintenance module 115 is generally as described in the Applicant's U.S. application Ser. No. 15/583,006 filed 1 May 2017, entitled "Printer having L-shaped maintenance modules for a plurality of printheads", the contents of which are incorporated herein by reference.

Each maintenance module 115 is fixedly mounted between the end brackets 102 and 104 of the inkjet module 100, and each defines a space or opening through which a respective print module 200 can extend and retract between the printing position (FIG. 3) and the maintenance position (FIG. 4), respectively. Accordingly, in the printing position, each printhead 216 is positioned at a suitable spacing from the media web.

Figure 14:
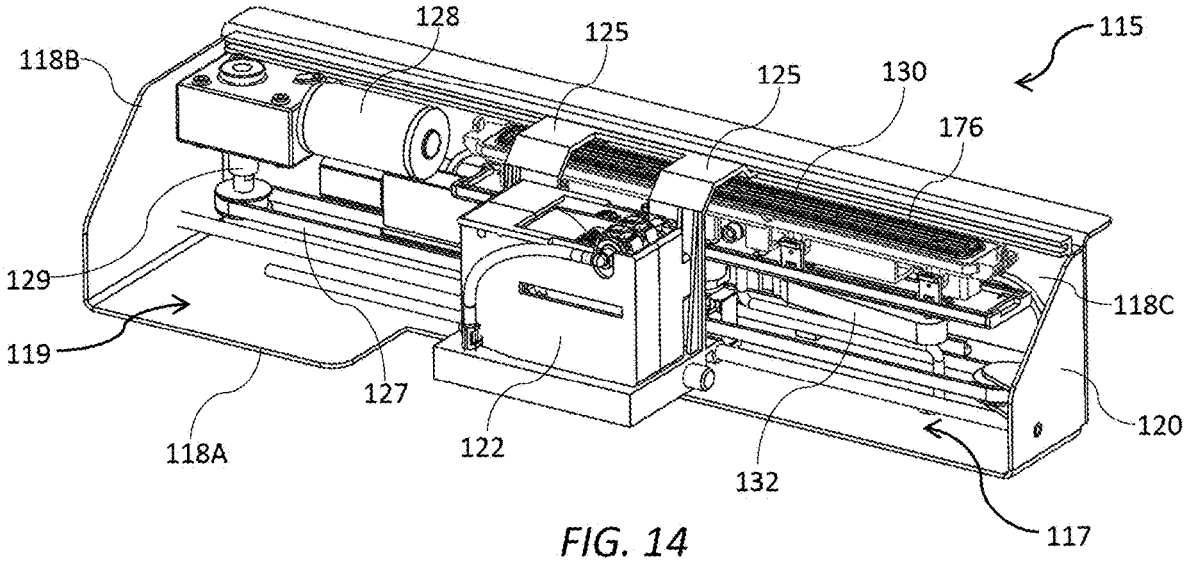
FIG. 14 is a perspective view of a maintenance module during printhead wiping.
Figure 15:
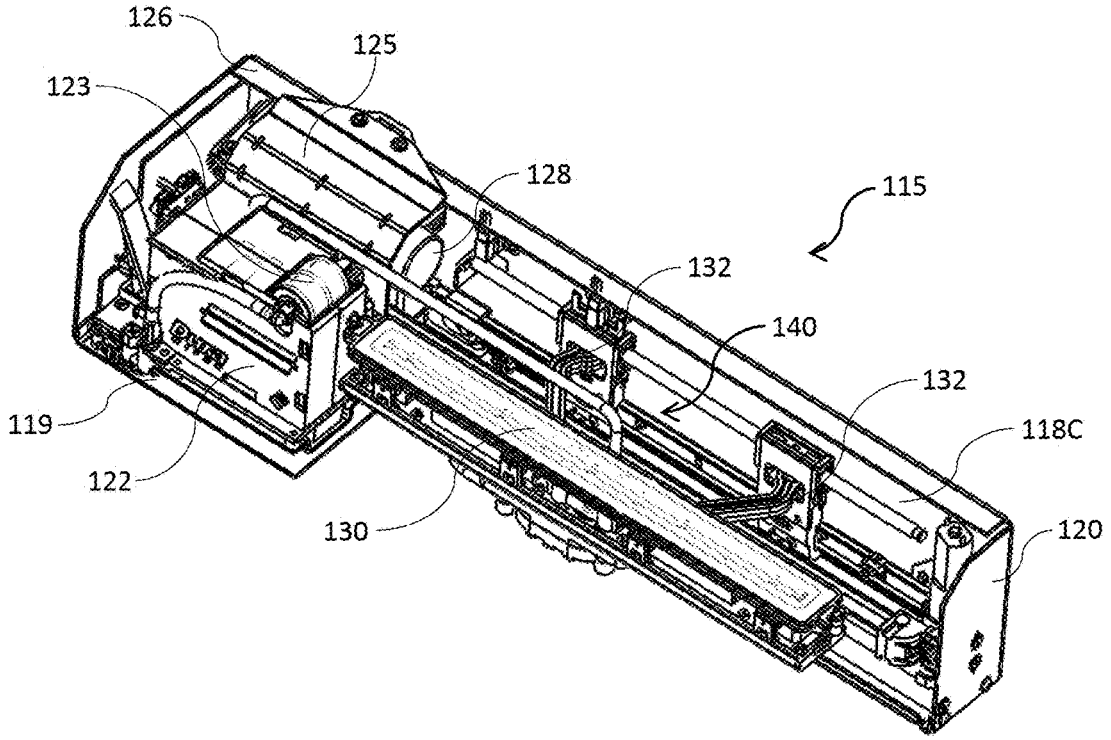
FIG. 15 is a perspective view of the maintenance module during printhead capping.

Referring to FIGS. 14 and 15, the L-shaped frame 120 of the maintenance module 115 comprises a base plate 118A with a shorter side plate 118B and a longer side plate 118C extending upwards therefrom. The shorter leg 119 comprises the shorter side plate 118B and a corresponding part of the base plate 118A; the longer leg 117 comprises the longer side plate 118C and a corresponding part of the base plate 118A. The L-shaped frame 120 houses the wiper carriage 122 for wiping the printhead 216 and a capper 130 for capping the printhead.

Figure 12:
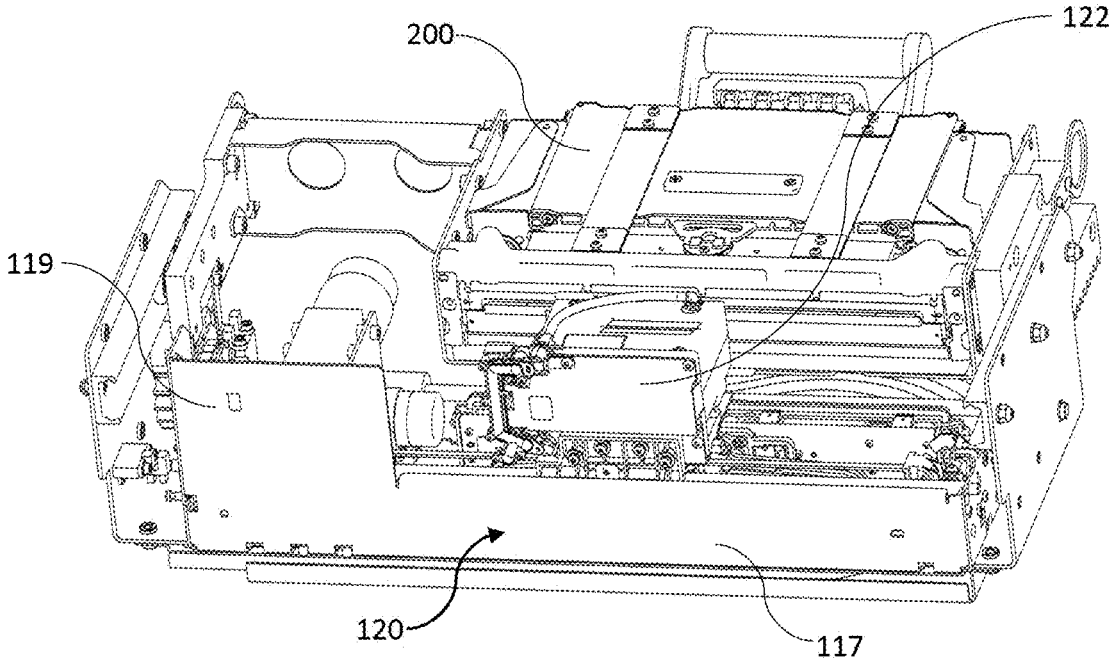
FIG. 12 is a bottom perspective of the inkjet module during printhead wiping.
Figure 13:
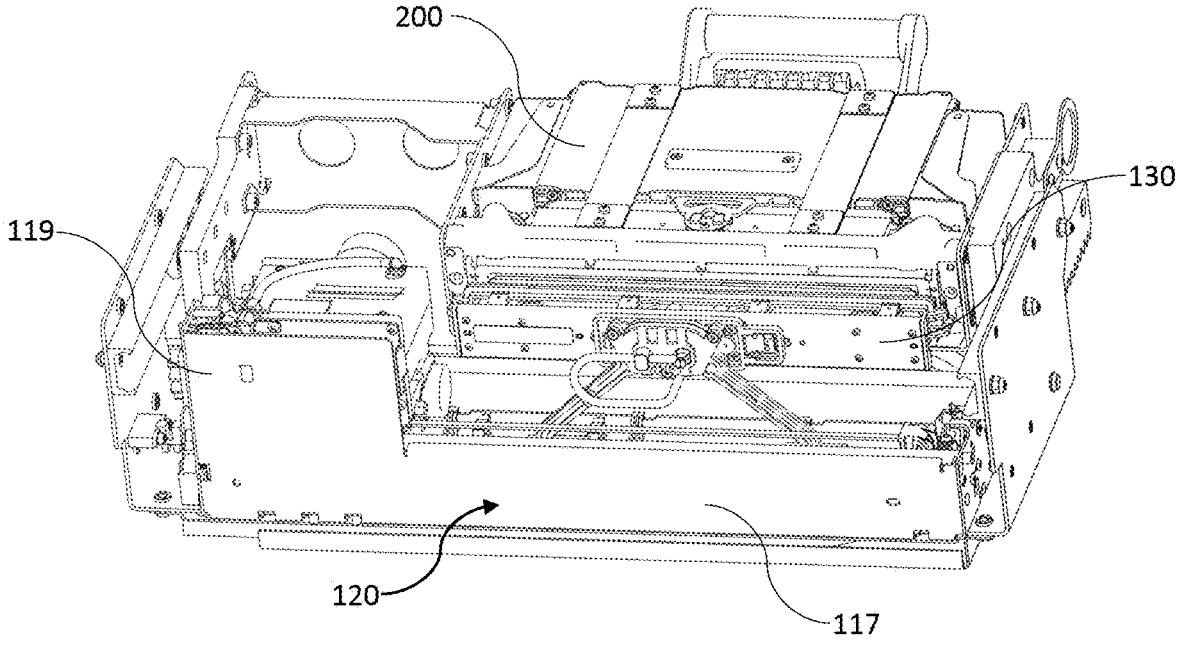
FIG. 13 is a bottom perspective of the inkjet module during printhead capping.

As shown in FIGS. 13 and 15, the wiper carriage 122 is in its home or parked position, whereby the wiper is positioned within the shorter leg 119 of the L-shaped frame 120. As shown in FIGS. 12 and 14, the capper 130 is in its home or parked position, whereby the capper is positioned within the longer leg 117 of the L-shaped frame 120.

The wiper carriage 122 includes a length of wiping material 123, which moves longitudinally along a length of the print module 200 to wipe the printhead 216. The wiper carriage 122 is supported by one or more overhead arms 125, which are slidingly engaged in a carriage rail 126 fixed to the longer side plate 118C and extending along the longer leg 119 of the frame 120. In FIGS. 12 and 14, the wiper carriage 122 has moved from its home position and is partway through a longitudinal wiping operation. The capper 130 is in its parked position and it can be seen that the overhead arms 125 bridge over the capper during the wiping movement of the wiper carriage 122. The wiper carriage 124 is traversed by means of an endless belt 127 driven by a bidirectional carriage motor 128 and belt drive mechanism 129. Printhead wipers of the type having a carriage carrying a web of wiping material are described in, for example, U.S. Pat. No. 4,928,120.

The capper 130 is mounted to the longer side plate 118C of the L-shaped frame 120 via a pair of hinged arms 132, which laterally extend and retract the capper into and away from a space occupied by the printhead 216 by means of a suitable retraction mechanism 140, such as those described in U.S. application Ser. No. 15/583,006. The capper 130 is shown in its capping position in FIGS. 13 and 15 with both arms 132 extended, while the wiper carriage 122 is parked in its home position.

For capping operations, the print module carrier 202 is lifted initially from a printing position into a transition position. With the print module carrier 202 in its highest transition position, the capper 130 is extended, and the print module carrier 202 then gently lowered to the maintenance position such that the printhead 216 is capped by a perimeter seal 176 of its respective capper. The reverse process configures the inkjet module 100 back into the printing position.

Similarly, for wiping operations, the print module carrier 202 is lifted from the printing position and raised initially into a transition position. With the print module carrier 202 in its highest transition position, the wiper carriage 122 is moved beneath the printhead 216 and the print module carrier gently lowered into the maintenance position so that the wiping material 123 is contacts a nozzle plate of the printhead. Typically, the wiping material 123 is resiliently mounted to allow a generous tolerance when the print module carrier 202 is lowered. Once the wiping material 123 is engaged with the printhead 216, the wiper carriage 122 is traversed lengthwise along the printhead to wipe ink and/or debris from the nozzle plate of the printhead.

Print Module 200

Figure 16:
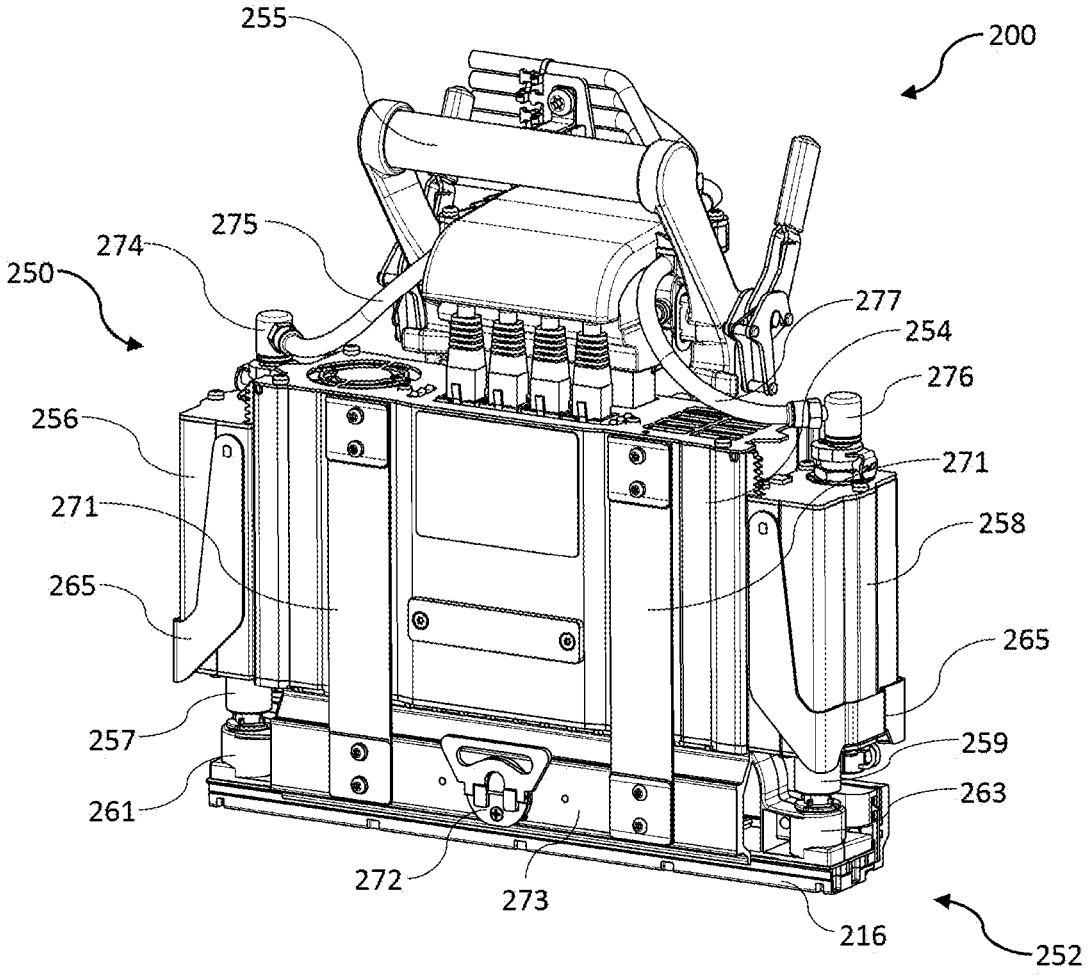
FIG. 16 is a perspective view of a print module.

The print module 200 will now be described in further detail with reference to FIGS. 16 to 18. The print module 200 comprises a supply module 250 engaged with a replaceable printhead cartridge 252, which includes the printhead 216. The printhead cartridge 252 may be of a type described in, for example, the Applicant's U.S. application Ser. No. 15/583,099 filed 1 May 2017, the contents of which are incorporated herein by reference.

The supply module 250 comprises a body 254 housing electronic circuitry for supplying power and data to the printhead 216. A handle 255 extends from an upper part of the body 254 to facilitate user removal and insertion into the sleeve 207 of the print module carrier 202 (FIG. 9).

The body 254 is flanked by an ink inlet module 256 and an ink outlet module 258 positioned on opposite sidewalls of the body. Each of the ink inlet and ink outlet modules has a respective ink coupling 257 and 259 engaged with complementary inlet and outlet couplings 261 and 263 of the printhead cartridge 252. The printhead cartridge 252 is supplied with ink from an ink delivery system (not shown) via the ink inlet module 256 and circulates the ink back to the ink delivery system via the ink outlet module 258.

The ink inlet module 256 and ink outlet module 258 are each independently slidably movable relative to the body 254 towards and away from the printhead cartridge 252. Sliding movement of the ink inlet and outlet modules 256 and 258 enables fluidic coupling and decoupling of the printhead cartridge 252 from the supply module 250. Each of the ink inlet and outlet modules 256 and 258 has a respective actuator in the form of a lever 265, which actuates sliding movement of the modules. Each lever 265 rotates about an axis perpendicular to the printhead 216 and is operatively connected to a pair of lever pinions 281. Rotation of the lever pinions 281 causes lateral sliding of movement of the inlet and outlet modules 256 and 258 relative to the body 254 via engagement with complementary lever racks 283 extending upwards and fixedly mounted relative to the body. This lever arrangement minimizes the overall width of the print module 200. As shown in FIGS. 16 and 18, the ink inlet module 256 and ink outlet module 258 are both lowered and the printhead cartridge 252 is fluidically coupled to the supply module 250. As shown in FIG. 17, the ink inlet and outlet modules 256 and 258 are both raised and the printhead cartridge 252 is fluidically decoupled from the supply module 250.

Figure 17:
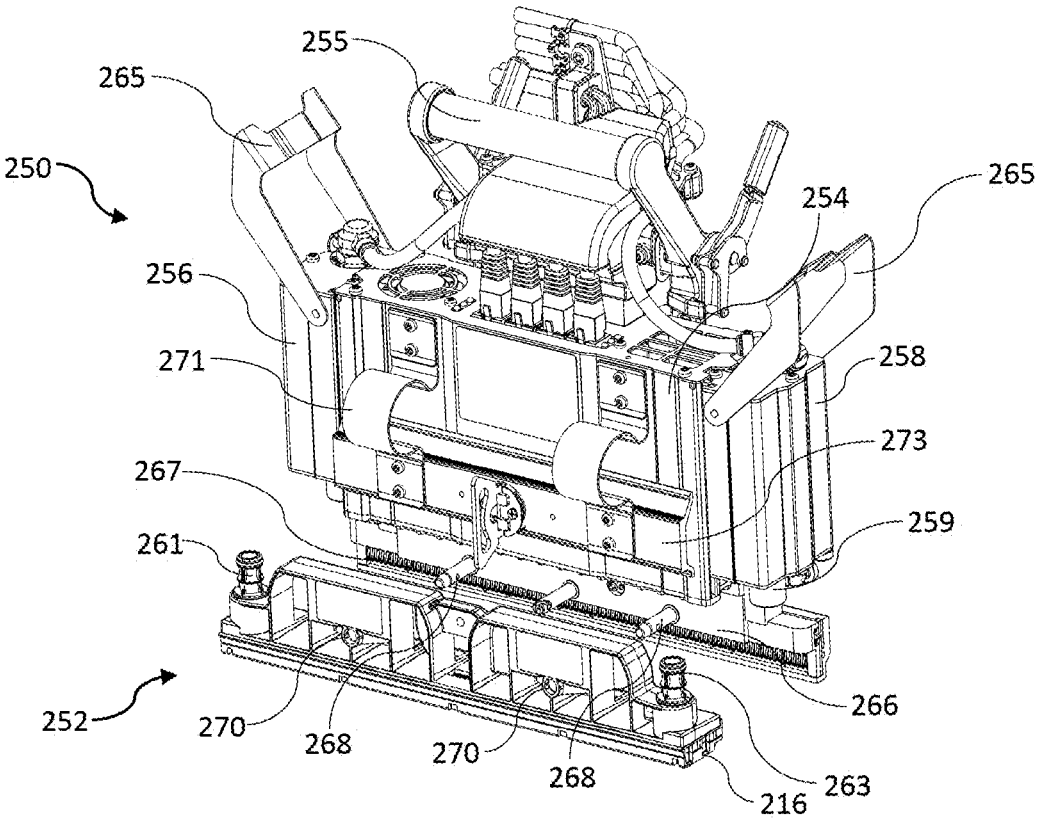
FIG. 17 is a perspective view of the print module with a printhead cartridge being decoupled.
Figure 18:
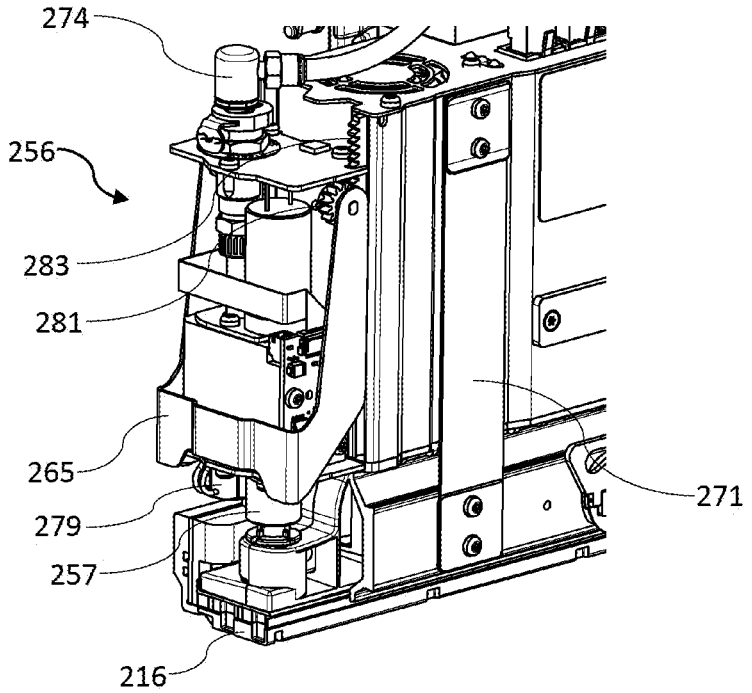
FIG. 18 shows an ink inlet module of the print module.

Still referring to FIG. 17, the supply module 250 has a clamp plate 266 extending from a lower part of the body 254. The lower part of the body 254 additionally has a row of electrical contacts 267 for supplying power and data to the printhead 216 via a complementary row of contacts (not shown) on the printhead cartridge 252 when the printhead cartridge is coupled to the supply module 250.

A set of locating pins 268 extend from the clamp plate 266 perpendicularly with respect to a sliding movement direction of the ink inlet and outlet modules 256 and 258. In order to install the printhead cartridge 252, each locating pin 268 is aligned with and received in a complementary opening 270 defined in the printhead cartridge 252. The printhead cartridge 252 is slid in the direction of the locating pins 268 towards the clamp plate 266. Once the printhead cartridge 252 is engaged with the clamp plate 266, a hinged clamp 273, connected to the body 254 via hinges 271, is swung downwards to clamp the printhead cartridge 252 against the clamp plate. The printhead cartridge 252 is locked in place by a fastener 272 on the hinged clamp 273. Finally, the ink inlet and outlet modules 256 and 258 are slid downwards via actuation of the levers 265 to fluidically couple the printhead cartridge 252 to the supply module 250. The reverse process is used to remove the printhead cartridge 252 from the supply module 252. The manual removal and insertion process, as described, can be readily and cleanly performed by users within a matter of minutes and with minimal loss of downtime in a digital press.

The ink supply module 256 is configured for receiving ink at a regulated pressure from an inlet line of an ink delivery system (not shown). A suitable ink delivery system for use in connection with the print modules 200 employed in the present invention is described in the Applicant's U.S. application Ser. No. 15/582,979, the contents of which are incorporated herein by reference. The ink inlet module 256 has an inlet port 274 for receiving ink from an ink reservoir (not shown) via an inlet line 275, while the ink outlet module 258 has an outlet port 276 for returning ink to the ink reservoir via an outlet line 277.

The ink inlet and outlet modules 256 and 258 independently house various components for providing local pressure regulation at the printhead 216, dampening ink pressure fluctuations, enabling printhead priming and de-priming operations, isolating the printhead for transport etc. In FIG. 18, the ink inlet module 256 is shown with a cover removed to reveal certain components of the ink inlet module. For example, there is shown a control PCB 278 having an ink pressure sensor and a microprocessor, which provides feedback to a control valve 279 for controlling a local pressure at the printhead 216. It will be appreciated that these and other components may be housed in the ink inlet and outlet modules 256 and 258.

Alternative Inkjet Module 300

Figure 19:
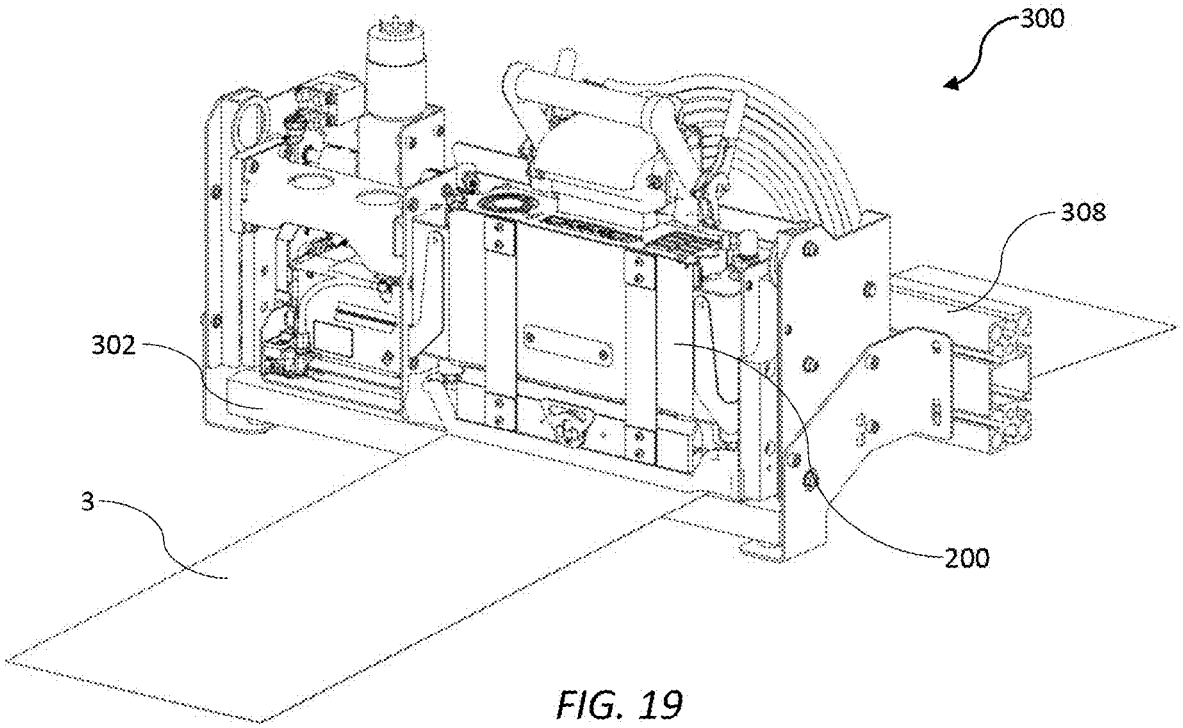
FIG. 19 shows an alternative inkjet module in a printing position.
Figure 20:
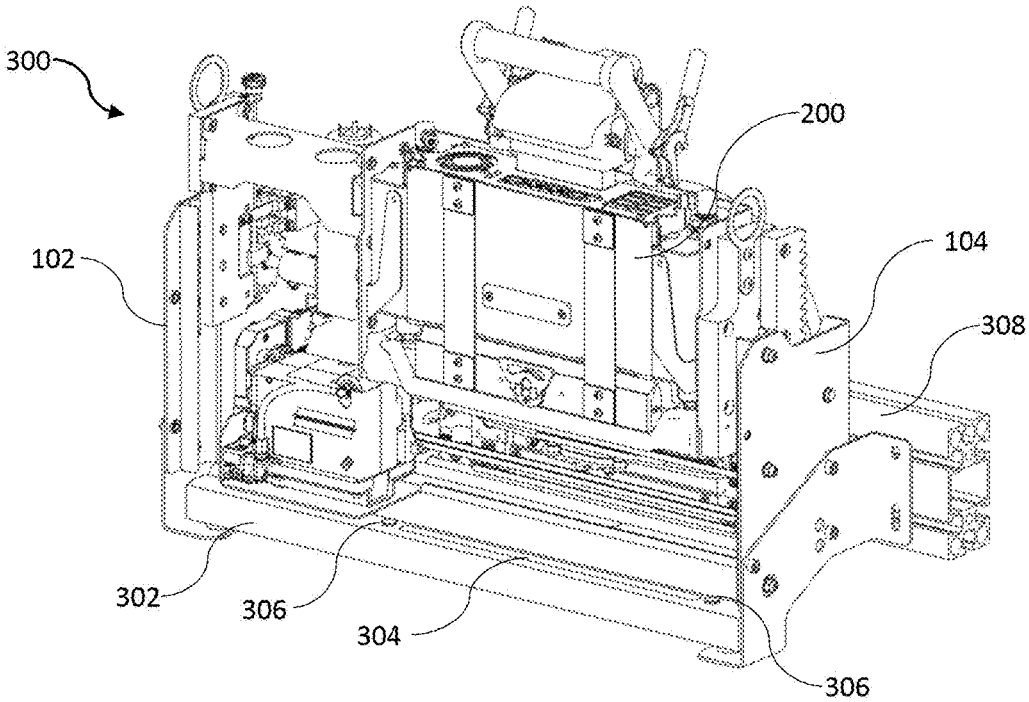
FIG. 20 shows the alternative inkjet module in a maintenance position.

Referring to FIGS. 19 and 20, an alternative inkjet module 300 additionally comprises a platen 302 incorporating a spittoon 304 connected between the end brackets 102 and 104. The platen 202 includes upwardly projecting datum formations 306 for complementary engagement with the printhead nest 212 and control of the pen-to-paper spacing (PPS). FIG. 19 shows the alternative inkjet module 300 in a printing position with the print module 200 lowered towards the spittoon 304 for printing onto a media web 3; FIG. 20 shows the printhead module 200 raised away from spittoon in a maintenance position.

The inkjet module 300 may be used as a standalone "drop-in" print engine for an existing analogue printing press via attachment of a fixed rear beam 308 to a suitable gantry (not shown). In this case, the inkjet module 300 minimizes integration costs even further.

From the foregoing, it will be appreciated that the present invention enables inkjet modules to be arranged in a relatively low-cost print engine, which minimizes integration, development and commercialization costs for OEMs whilst allowing versatility with respect to the number and arrangement of inkjet modules.

It will, of course, be appreciated that the present invention has been described by way of example only and that modifications of detail may be made within the scope of the invention, which is defined in the accompanying claims.

The invention claimed is:

1. An integrated inkjet module comprising:

first and second opposite end brackets;

a single print module asymmetrically positioned between the end brackets, the print module comprising an elongate printhead;

a wiper carriage positioned between a first end of the print module and the first end bracket, the wiper carriage being configured for longitudinally wiping the printhead;

a print module carrier supporting the print module, the print module carrier being mounted between the first and second end brackets and comprising a mounting arm bridging over the wiper carriage;

wherein the print module carrier is slidably liftable relative to the first and second end brackets; and a platen connected between the first and second end brackets, the platen being positioned for supporting print media passing below the printhead.

2. The inkjet module of claim 1 further comprising a lift mechanism for raising and lowering the print module carrier.

3. The inkjet module of claim 2, wherein the lift mechanism comprises a rack-and-pinion mechanism.

4. The inkjet module of claim 1, wherein the print module carrier is slidably engaged between first and second guide rails of the first and second end brackets, respectively.

5. The inkjet module of claim 4, the mounting brackets comprise one or more roller bearings for engagement with the first and second guide rails.

6. The inkjet module of claim 1, wherein the print module carrier comprises a sleeve for receiving the print module and a pair of mounting brackets engaged with respective guide rails, and wherein first mounting bracket is connected to the sleeve via the mounting arm bridging over the wiper carriage.

7. The inkjet module of claim 1 further comprising a capper extending alongside one longitudinal edge of the print module.

8. The inkjet module of claim 7, wherein the capper is reciprocally movable towards and away from the printhead.

9. The inkjet module of claim 1, wherein the platen comprises a spittoon.

10. A print engine comprising a print chassis having one or more inkjet modules according to claim 1.

11. The print engine of claim 10, wherein the inkjet modules are aligned along a media feed direction.

12. The print engine of claim 10, wherein a respective print module of each inkjet module is independently liftable relative to the print chassis.

* * * * *